US005357913A

United States Patent [19]

Okumura et al.

[11] Patent Number: 5,357,913

[45] Date of Patent: Oct. 25, 1994

[54] FLAME ARRESTER ARRANGEMENT FOR MARINE PROPULSION ENGINE

[75] Inventors: Hideyuki Okumura; Masanori Urita, both of Hamamatsu, Japan

[73] Assignee: Sanshin Kogyo Kabushiki Kaisha, Hamamatsu, Japan

[21] Appl. No.: 46,011

[22] Filed: Apr. 12, 1993

[30] Foreign Application Priority Data

Apr. 10, 1992 [JP] Japan ..... 4-116665

[51] Int. Cl.[5] ..... F02M 35/10

[52] U.S. Cl. ..... 123/184.34; 123/198 D

[58] Field of Search ..... 123/52 M, 52 MV, 52 MF, 123/198 E, 198 D, 179.1, 146.5 R, 572, 333, 557, 41.1

[56] References Cited

U.S. PATENT DOCUMENTS

| | | | |
|---|---|---|---|
| 2,909,165 | 10/1959 | Dolza | 123/52 MV |
| 3,111,937 | 11/1963 | Johnson et al. | 123/52 MV |
| 3,884,201 | 5/1975 | Cregan | 123/52 MV |
| 3,889,649 | 6/1975 | Polaner | 123/572 |
| 4,196,710 | 4/1980 | Lehar | 123/557 |
| 4,512,296 | 4/1985 | Herrington et al. | 123/146.5 R |
| 4,893,591 | 1/1990 | Nelson | 123/198 D |
| 5,062,401 | 11/1991 | Sugunuma | 123/333 |
| 5,063,885 | 12/1991 | Yoshioka | 123/52 MV |
| 5,072,704 | 12/1991 | Webb | 123/179.1 |

OTHER PUBLICATIONS

Brunswick publication–Mercruiser 1993 Stern Drives and Inboards, copyright 1992.

*Primary Examiner*—Tony M. Argenbright
*Assistant Examiner*—M. Macy
*Attorney, Agent, or Firm*—Knobbe, Martens, Olson & Bear

[57] ABSTRACT

A pair of embodiments of flame arrester arrangements for marine propulsion engines wherein the flame arrester is positioned vertically above the thermostat housing at one end of the engine and the plenum chamber for the intake manifold is disposed above the exhaust elbow of the engine so as to provide good induction efficiency and compact size. Different configurations of flame arresters are disclosed and they both provide very large effective inlet areas and, at the same time, good flame protection.

10 Claims, 5 Drawing Sheets

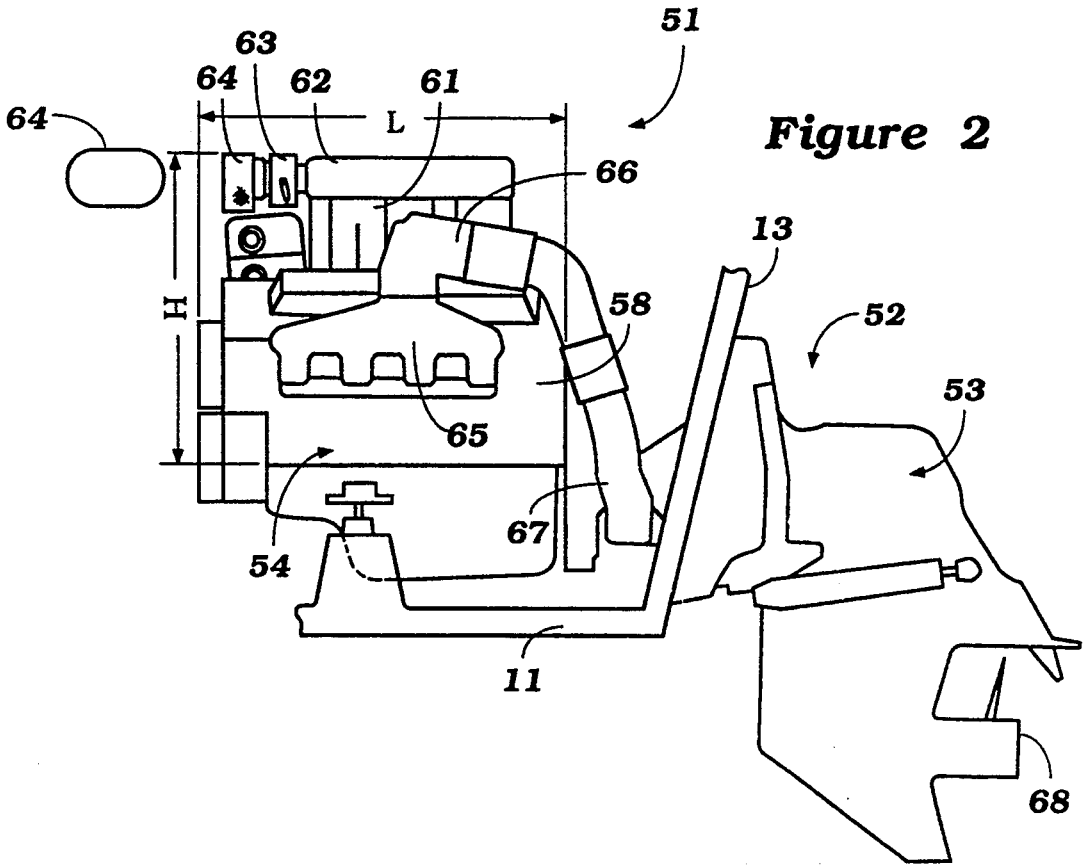
Figure 2
Figure 3
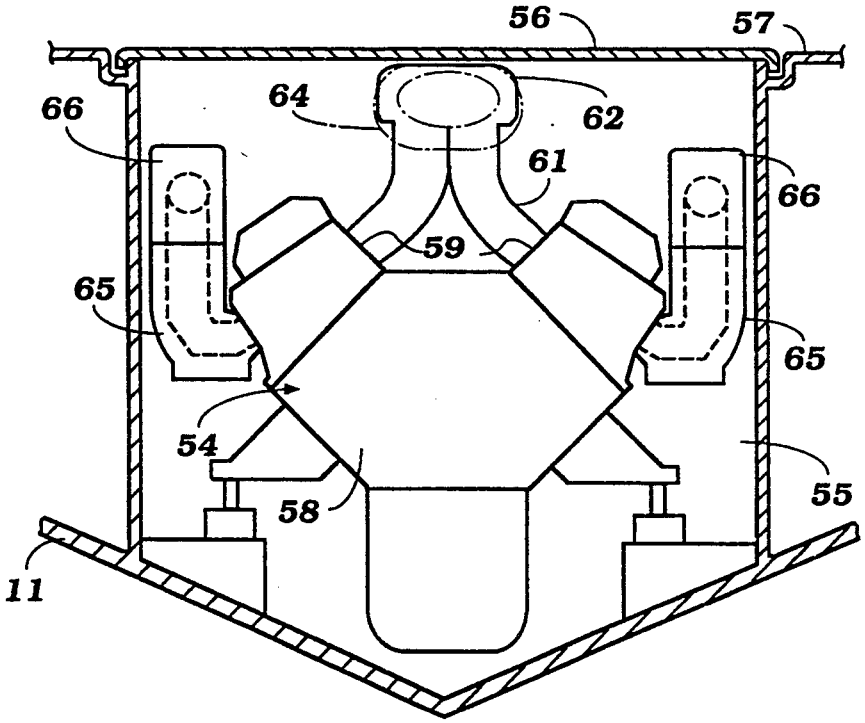

Figure 4
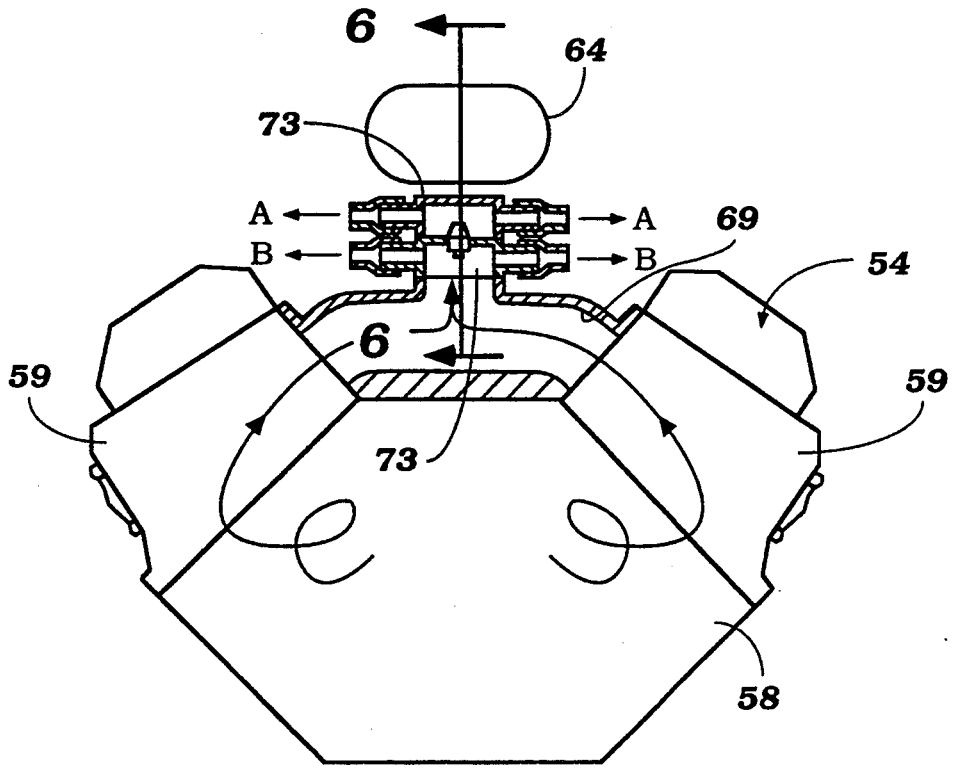
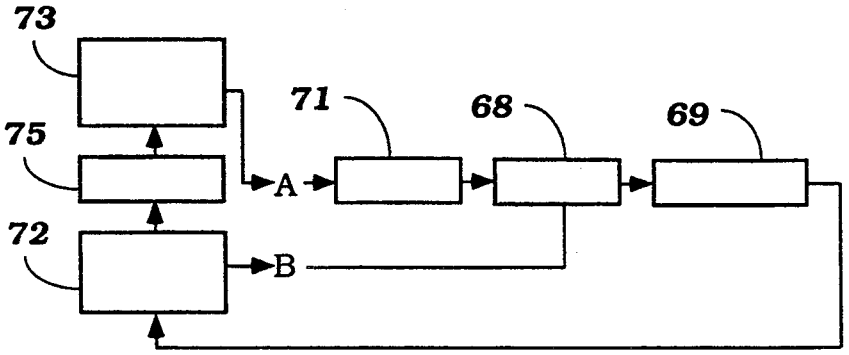
Figure 5

FLAME ARRESTER ARRANGEMENT FOR MARINE PROPULSION ENGINE

BACKGROUND OF THE INVENTION

This invention relates to a flame arrester arrangement for a marine propulsion engine and more particularly to a location for the components of a marine propulsion engine that permits a compact assembly and yet effective flame protection and induction efficiency.

Conventionally many types of marine watercraft are powered by internal combustion engines and particularly engines based upon automotive engines which are modified so as to suit marine application. As a result of this use of automotive type engines and for a variety of other reasons, the layout of certain components of the engine is not optimum for all aspects of engine performance. This may be best understood by reference to FIG. 1 wherein a conventional type of prior art marine propulsion engine is shown and is mounted in the hull of an associated watercraft which is shown partially in cross section and which is identified generally by the reference numeral 11. The engine, indicated generally by the reference numeral 12, is mounted within the hull 11 and forwardly of a transom 13 for driving an outboard drive type of propulsion unit (not shown) in a conventional manner.

The engine 12 includes a cylinder block 14 having a pair of inclined cylinder banks to which cylinder heads 15 are affixed in a known manner. An induction system, indicated generally by the reference numeral 16 is provided for delivering a fuel/air charge to the engine 12. The induction system 16 includes a forwardly facing air inlet and flame arrester 17 which supplies atmospheric air to a plenum chamber 18 which, in turn, serves the individual chambers of the engine through an intake manifold 19 having a plurality of individual runners that serve the cylinders of the engine.

Each cylinder bank is provided with an exhaust manifold 21 which delivers the exhaust gases upwardly to an exhaust elbow 22 that is disposed at the respective side of the engine. The exhaust elbows 22, in turn, deliver the exhaust gases to a "Y" pipe 23 having a discharge end 24 that communicates with an underwater exhaust gas discharge of the outboard drive unit.

The engine 12 is also water cooled and its temperature is maintained by a thermostat contained within a thermostat housing 25 disposed in the valley between the cylinder banks and at the forward end of the engine. Normally a throttle body 26 is provided directly above the thermostat housing 25 for controlling the air flow from the inlet device and flame arrester 17 into the plenum chamber 18.

As will be seen from the drawings, the plenum chamber 18 is disposed so that its lower periphery is lower than the upper periphery of the exhaust elbows 22 and this limits the transverse outwardly extending width of the plenum chamber 18. Furthermore, the inlet device 17 is positioned forwardly of the thermostat housing 25 and depends slightly below it. This disposition means that the air flow must flow radially into the inlet device 17 and then turn through 90° to enter the throttle body 26, thus limiting the size of the inlet device 17 and also restricting the air flow. In addition, the inlet device 17 then must extend beyond the end of the engine and specifically beyond the thermostat housing 25 so as to increase the length "L" of the engine while at the same time providing a relatively great height "H".

From the foregoing description of the prior art type of devices, it should be readily apparent that there are a number of compromises in the layout of the components which increase the overall size of the engine, decreases the induction efficiency and also somewhat restricts the flame arrester performance for the engine.

It is, therefore, a principal object of this invention to provide an improved flame arrester arrangement for a marine propulsion engine.

It is a yet further object of this invention to provide an improved induction system and other layout components for a marine engine that provides a compact engine, high induction efficiency and good flame arresting control.

SUMMARY OF THE INVENTION

This invention is adapted to be embodied in an internal combustion engine for a marine propulsion unit that is comprised of a cylinder block and an induction system for delivering an intake charge to the engine. An exhaust system is provided for exhausting exhaust gases from the engine and a liquid cooling system for the engine comprises a thermostat housing at one end of the engine and provided in an upper portion thereof. The exhaust system comprises an exhaust elbow for receiving exhaust gases from an exhaust manifold and discharging them into the body of water in which the watercraft is operating. The induction system includes an intake manifold having a plenum chamber disposed vertically above the upper end of the exhaust elbow and an atmospheric air inlet disposed at the one end of the engine. A flame arrester for inducting a charge into the manifold inlet end and restraining flame transmission from the inlet end is provided at the one end of the plenum chamber. The flame arrester is positioned vertically above the thermostat housing.

BRIEF DESCRIPTION OF THE DRAWINGS

FIG. 2 is a side elevational view, in part similar to (FIG. 1) and shows a first embodiment of the invention.

FIG. 3 is a cross sectional view taken from the rear of this embodiment.

FIG. 4 is an enlarged front elevational view, with a portion shown in section.

FIG. 5 is a schematic view showing the cooling system of the engine.

DETAILED DESCRIPTION OF THE PREFERRED EMBODIMENTS OF THE INVENTION

Figure 1:
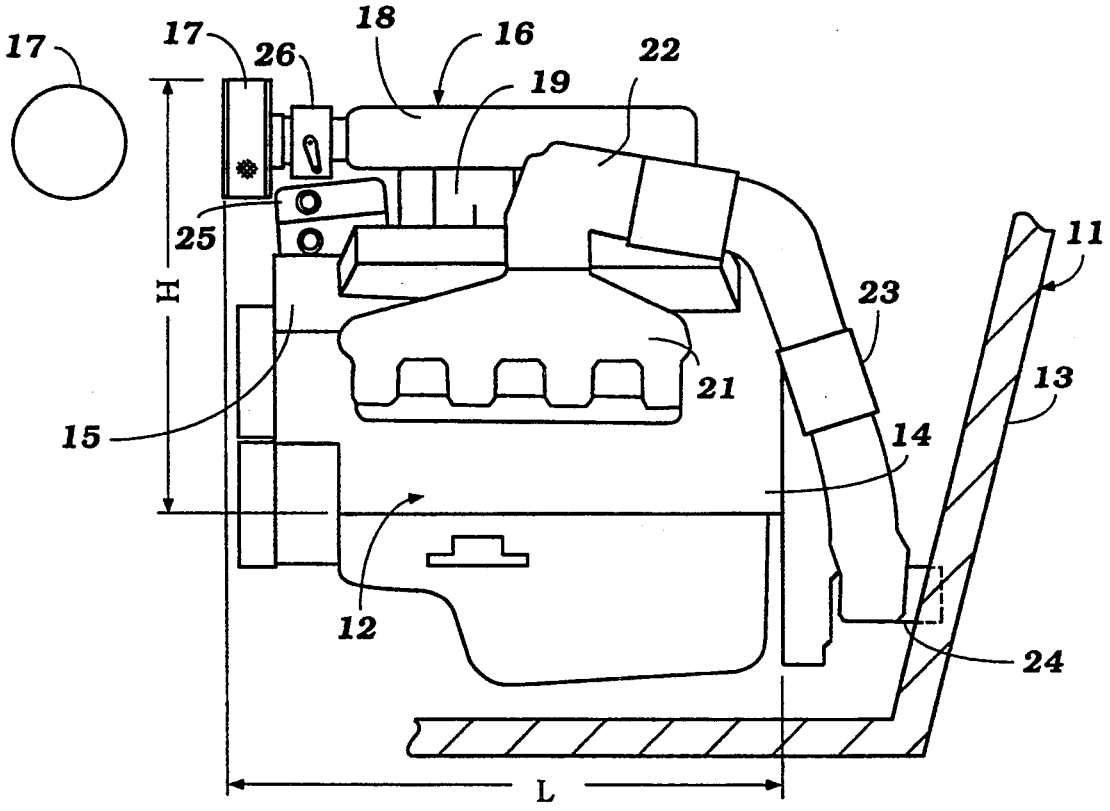
Figure 1 Prior Art
FIG. 1 is a side elevational view of a marine propulsion engine constructed in accordance with a prior art type of construction.

Referring first to the embodiment of FIGS. 2 through 8 and initially to FIGS. 2 and 3, an embodiment of this invention is identified generally by the reference numeral 51 and has certain components which are the same as the prior art type of construction. Where that is the case, these components have been identified by the same reference numerals and this includes the watercraft hull 11, the transom 13 and, as illustrated in this embodiment, the marine outboard drive, indicated generally by the reference numeral 52 and including an outboard drive portion 53 mounted to the rear of the transom 13 in a well known manner.

FIG. 3 also shows how the engine, indicated generally by the reference numeral 54 in this embodiment, is positioned within an engine compartment 55 formed forwardly of the transom 51 and enclosed at its upper end by an engine cover 56 which is sealingly engaged with a surrounding deck 57 of the hull 11.

The engine 54 is also of the V type and includes a cylinder block 58 having a pair of angularly disposed cylinder banks to which respective cylinder heads 59 are affixed. An intake manifold 61 is positioned in the valley between the cylinder banks and includes an upwardly extending plenum portion 62. The plenum chamber portion 62 receives intake air through a throttle body 63 in which a throttle control valve is provided for controlling the speed of the engine. A combined flame arrester and air intake device 64 is positioned forwardly of the throttle body 63 and draws the atmospheric charge from within the engine compartment 55 while, at the same time, precluding the discharge of any backfiring through the intake manifold to the engine compartment 55.

There is provided exhaust manifold 65 for each cylinder bank which exhaust manifold 65 delivers the exhaust gases to exhaust elbows 66. As will be noted the exhaust elbows 66 are disposed outwardly of the sides of the engine and terminate at their upper ends below the plenum chamber 62 so as to offer access to the plenum chamber 62 and to permit its transversed extension well beyond the area shown in the drawings.

The exhaust elbows 66, like the prior art constructions, deliver the exhaust gases to a "Y" pipe 67 which then transfers them to the outboard drive unit 53 for discharge through a propeller through the hub type exhaust gas discharge 68.

Figure 6:
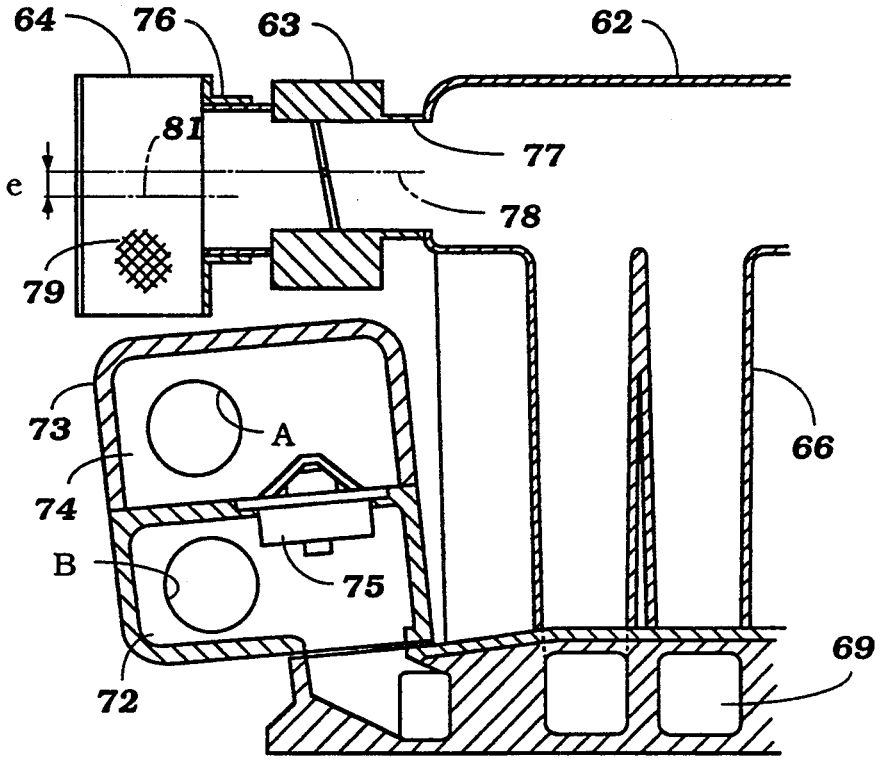
FIG. 6 is an enlarged cross sectional view taken along the line 6—6 of FIG. 4.
Figure 7:
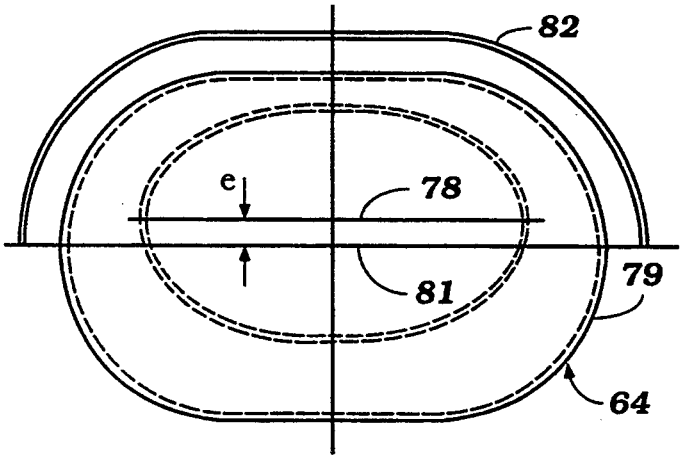
FIG. 7 is an enlarged front elevational view of the flame arrester.
Figure 8:
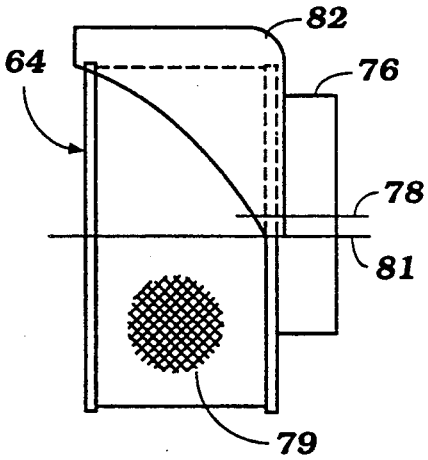
FIG. 8 is a side elevational view of the flame arrester.

The cooling system for the engine 54 may be best understood by reference to FIGS. 4 through 6 with FIG. 5 showing certain of the components in a schematic fashion. These components include a water pump 68 which is driven by the engine 54 in a known manner and which delivers the coolant to a cooling jacket 69 of the cylinder block 58 and cylinder heads 69. The cooling water for the water pump 68 is either drawn through a heat exchanger 71 or directly from the body of water in which the watercraft is operating. From the engine cooling jacket 69, the coolant is delivered to a lower compartment 72 of a thermostat housing 73 which, like the prior art constructions, is positioned at the forward upper end of the engine 54.

Unlike the prior art type of constructions, however, the flame arrester air inlet device 64 is disposed directly above the thermostat housing 73 rather than forwardly of it so as to decrease the length "L" of the engine without significantly increasing the height "H". The lower thermostat housing chamber 72 communicates with an upper chamber 74 through a wall in which a temperature responsive thermostat 75 is positioned. When the engine coolant is below the temperature at which the thermostat 75 is operating, the coolant is delivered back to the coolant pump 68 through bypass conduits "B" which extend from the sides of the lower thermostat housing portion 72. However, when the thermostat 75 is at or above the opening temperature, the coolant will flow primarily into the upper chamber 74 and be discharged either back to the heat exchanger 71 or to the body of water in which the watercraft is operating through main return conduits "A".

From the described construction it should be readily apparent that the positioning of the air intake device and flame arrester 64 above the thermostat housing 73 and the elevation of the plenum chamber 62 permits a minor increase in overall height of the engine while, at the same time, maintaining a short length. In addition, the construction of the flame arrester 64, as will now be described by particular reference to FIGS. 6 through 8, permits a very large cross sectional flow area and good induction efficiency with a minimum amount of change in direction of air flow.

Referring now specifically to these figures, it should be noted that the flame arrester inlet device 64 has a sleeve portion 76 that is received on an inlet end 77 of the throttle body 63 which inlet end has a generally oval configuration with a center line 78. A perforated flame arresting material 79 is provided which has also an oval shape but which center 81 is disposed at a lower level than the center line 78 as indicated by the dimension "e" as illustrated in the figures so as to drop the overall height while, at the same time, avoiding any loss in effective flow area. A metal shield 82 encircles the upper portion of the flame arrester 79 and shields it from water or other foreign objects and also will direct any flame which escapes in a downward direction wherein no damage is likely to occur.

Figure 9:
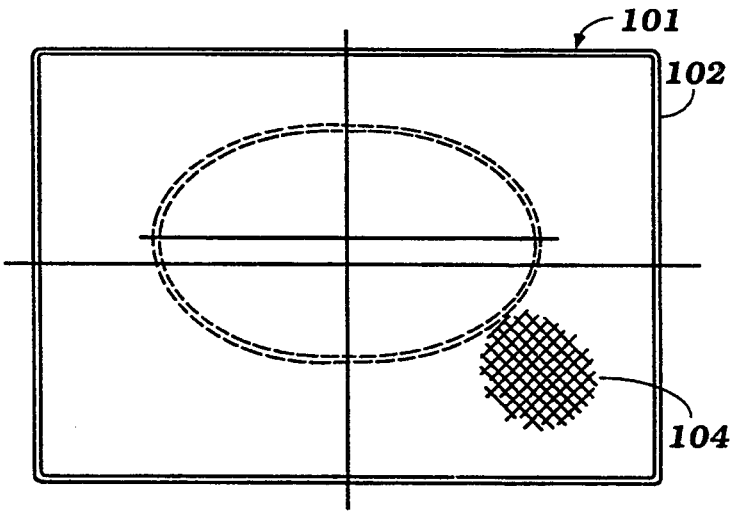
FIG. 9 is a front elevational view, in part similar to FIG. 7 and shows another embodiment of the flame arrester.
Figure 10:
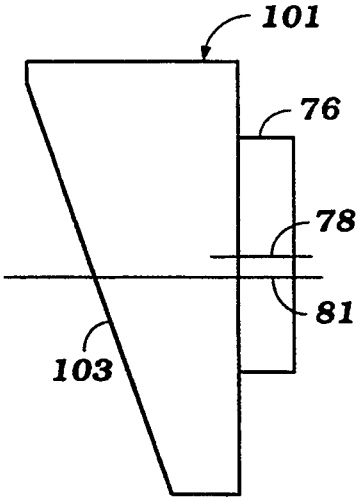
FIG. 10 is a side elevational view of the flame arrester of this embodiment.

FIGS. 9 and 10 show another embodiment of flame arrester air intake device, indicated generally by the reference numeral 101 which may be utilized in conjunction with the invention. This embodiment has the advantages of the embodiment of FIGS. 7 and 8 and furthermore eliminates the necessity for the intake charge to turn through 90° before it can flow through the outlet 76.

In this embodiment, the outlet 76 is configured and arranged as in the preceding embodiment and for that reason the same reference numeral has been applied. However, there is provided a sheet metal outer shroud 102 that has a generally rectangular configuration but which is eccentric as with the previously described embodiment and which is cutoff at an angle 103 at its forward end. A flame arresting perforated material 104 extends across this opening 103 and thus provides a large surface area and also reduces the necessity for the air to turn through 90°. In all other regards, this embodiment is the same as that previously described and, for that reason, further description of it is believed to be unnecessary.

It should be understood that the foregoing description is that of preferred embodiments of the invention and that the described constructions provide very efficient induction control, compact engine size and good flame arresting properties. Of course, various changes and modifications may be made from the described preferred embodiments of the invention without departing from the spirit and scope of the invention, as defined by the appended claims.

We claim:

1. An internal combustion engine for a marine propulsion unit comprising a cylinder block, an induction system for delivering an intake charge to said engine, an exhaust system for exhausting exhaust gases from said engine, a liquid cooling system for said engine comprising a thermostat housing at one end of said engine and formed in an upper portion thereof, said exhaust system comprising an exhaust elbow for receiving exhaust gases from an exhaust manifold and discharging them to the body of water in which the associated watercraft is operating, said induction system including an intake manifold having a plenum chamber disposed vertically above the upper end of said exhaust elbow and an atmospheric air inlet disposed at said one end of said engine, and a flame arrester for inducting a charge into said manifold inlet end and for restraining flame travel from said inlet end, said flame arrester being positioned vertically above and in overlying relation to said thermostat housing.

2. An internal combustion engine for a marine propulsion unit as set forth in claim 1 wherein the flame arrester provides axial flow into the air inlet opening.

3. An internal combustion engine for a marine propulsion unit as set forth in claim 1 wherein the engine is provided with a pair of cylinder banks disposed at an angle with each cylinder bank having a respective exhaust system including an exhaust elbow and an exhaust manifold, the plenum chamber being disposed between said exhaust elbows and completely above said exhaust manifolds.

4. An internal combustion engine for a marine propulsion unit as set forth in claim 3 wherein the exhaust elbows discharge to a common "Y" pipe.

5. An internal combustion engine for a marine propulsion unit as set forth in claim 4 wherein the thermostat housing is positioned in the valley between the cylinder banks.

6. An internal combustion engine for a marine propulsion unit as set forth in claim 5 wherein the flame arrester provides axial flow into the air inlet opening.

7. An internal combustion engine for a marine propulsion unit as set forth in claim 6 wherein the central axis of the flame arrester is disposed eccentrically to the central axis of the atmospheric air inlet and closer to the thermostat housing.

8. An internal combustion engine for a marine propulsion unit as set forth in claim 1 wherein the central axis of the flame arrester is disposed eccentrically to the central axis of the atmospheric air inlet and closer to the thermostat housing.

9. An internal combustion engine as set forth in claim 1, wherein the intake manifold has a plurality of runners extending upwardly from the cylinder banks and terminating within the plenum chamber at a point above the exhaust manifolds.

10. An internal combustion engine as set forth in claim 1, wherein the flame arrester does not extend beyond the thermostat housing at the one end of the engine.

* * * * *